US009262919B2

(12) United States Patent
Kim

(10) Patent No.: US 9,262,919 B2
(45) Date of Patent: Feb. 16, 2016

(54) STREET LAMP FOR PROVIDING SAFE DRIVING INFORMATION AND SYSTEM FOR PROVIDING SAFE DRIVING INFORMATION USING STREET LAMP

(71) Applicant: KMW INC., Hwaseong, Gyeonggi-Do (KR)

(72) Inventor: Duk Yong Kim, Gyeonggi-Do (KR)

(73) Assignee: KMW INC., Hwaseong, Gyeonggi-Do (KR)

( * ) Notice: Subject to any disclaimer, the term of this patent is extended or adjusted under 35 U.S.C. 154(b) by 53 days.

(21) Appl. No.: 14/192,474

(22) Filed: Feb. 27, 2014

(65) Prior Publication Data

US 2014/0176347 A1 Jun. 26, 2014

Related U.S. Application Data

(63) Continuation of application No. PCT/KR2012/006980, filed on Aug. 31, 2012.

(30) Foreign Application Priority Data

Aug. 31, 2011 (KR) ..... 10-2011-0087676

(51) Int. Cl.

| | |
|---|---|
| ***G08B 21/00*** | (2006.01) |
| ***G08G 1/095*** | (2006.01) |
| ***G08G 1/0967*** | (2006.01) |
| ***G08G 1/16*** | (2006.01) |
| ***E01F 9/00*** | (2006.01) |

(52) U.S. Cl.

CPC ..... *G08G 1/095* (2013.01); *E01F 9/005* (2013.01); *G08G 1/096716* (2013.01); *G08G 1/096758* (2013.01); *G08G 1/096791* (2013.01); *G08G 1/164* (2013.01)

(58) Field of Classification Search

CPC ..... G08G 1/09; G08G 1/093
USPC ..... 340/428, 905, 910, 933, 937
See application file for complete search history.

(56) References Cited

U.S. PATENT DOCUMENTS 6,690,292 B1 * 2/2004 Meadows et al. ..... 340/905

FOREIGN PATENT DOCUMENTS

| | | | |
|---|---|---|---|
| CN | 101996487 | A | 3/2011 |
| JP | 2004-027528 | A | 1/2004 |
| JP | 2004259248 | A | 9/2004 |
| JP | 2008293208 | A | 12/2008 |
| KR | 10-2002-0043264 | A | 12/2000 |
| KR | 10-2002-0075594 | A | 10/2002 |
| KR | 10-2007-0001862 | A | 1/2007 |
| WO | WO-2006/129298 | A2 | 12/2006 |

* cited by examiner

*Primary Examiner* — Jeffery Hofsass
(74) *Attorney, Agent, or Firm* — Mintz Levin Cohn Ferris Glovsky and Popeo, P.C.; Kongsik Kim; Colleen H. Witherell

(57) ABSTRACT

A street lamp for providing the safe driving information comprises: a main lighting portion for lighting a road; a vehicle reception portion for receiving an accident or malfunction occurrence signal from a vehicle in an accident or which is malfunctioning; a control portion for generating accident or malfunction recognition signals that can be distinguished, in accordance with the reception of the accident or malfunction occurrence signal; and a vehicle transmitting portion for selectively transmitting the accident or malfunction occurrence signal to vehicles in front and behind the location of the accident or the malfunction.

11 Claims, 10 Drawing Sheets

STREET LAMP FOR PROVIDING SAFE DRIVING INFORMATION AND SYSTEM FOR PROVIDING SAFE DRIVING INFORMATION USING STREET LAMP

CROSS-REFERENCE TO RELATED APPLICATIONS

The present application is a continuation of International Application No. PCT/KR2012/006980 filed on Aug. 31, 2012, which claims priority to Korean Application No. 20-2011-0087676 filed on Aug. 31, 2011, which applications are incorporated herein by reference.

TECHNICAL FIELD

The present disclosure relates to a street lamp for providing safe driving information and a system for providing safe driving information using the street lamp. More particularly, the present disclosure relates to a safe driving information providing street lamp which can notify a vehicle passing in the vicinity of an accident occurrence position of accident occurrence as soon as the accident has occurred so that a secondary collision accident can be prevented and a system for providing safe driving information using the street lamp.

BACKGROUND ART

In general, a vehicle running on a freeway usually runs at a high speed exceeding 100 km/h. Therefore, it is highly probable that a driver of the vehicle may cause a secondary collision with a stopped accident vehicle due to failing to recognize the accident ahead while driving.

In particular, when it is thickly foggy or at night time, visibility is limited. Therefore, even when a driver reduces the speed of a vehicle after noticing an accident vehicle ahead of the vehicle, the secondary collision may unavoidably occur because the braking distance is long compared to the distance to the accident vehicle and thus, the running speed is still high when reaching the accident vehicle.

In addition, even if the visibility is good at day time, the secondary collision may also be caused, for example, on a curved road, by failing to see an accident situation.

Thus, big accidents of chain collisions involving, for example, ten or more vehicles often occur on freeways. However, in the past, no means for preventing such chain collisions have been provided.

In addition, while vehicles are being driven on a freeway, a specific section suddenly becomes a delay or congestion section. Under a situation where the visibility is low, when it is not recognized that the delay or congestion section exists ahead, a rear-end collision may occur even if there is not an accident situation.

While a vehicle is being driven at a high speed on a freeway, a driver of the vehicle may feel sleepy due to monotonous driving. Statics show that about 75% of drivers of vehicles driven on a freeway feel sleepy within 90 minutes after starting the driving. This is because, as a harbinger of sleepiness, the drivers suffer a decline in a cognitive ability for a surrounding situation and hence, for a speed of a vehicle running ahead, compared to the usual care even if the drive is not dozing.

When a vehicle suddenly meets a delay or congestion section while being driven in a smoothly flowing section, the vehicle may not be properly decelerated and thus, rear-end a vehicle driven ahead. An example of a system that can prevent such an accident in advance is disclosed in Korean Patent No. 10-0999812.

However, in the prior art, occurrence of an accident is recognized by a traffic operation center or the like provided in a distance from the accident spot and then, the occurrence of the accident is notified to subsequent vehicles through a display device in the vicinity of the spot of the accident, a radio broadcast or the like. Despite this, an immediate measure may not be taken and thus, a second rear-end collision may not be completely prevented.

In addition, since accidents are sensed merely based on a witness report by a phone, a CCTV image or the like, a notification action of the accident occurrence is unavoidably further delayed when the witness report or the reading or recognition of the CCTV image is delayed. In addition, the accident report by the phone has a problem in that since it is difficult for the witness to accurately describe the accident spot, it is not easy to determine the correct accident spot.

SUMMARY

In order to solve the problems as described above, an object of the present disclosure is to provide a safe driving information providing street lamp which is capable of giving a warning of occurrence of an accident around an accident spot immediately after the occurrence of the accident so as to prevent a secondary rear-end collision and a safe driving information providing system using the street lamp.

Another object of the present disclosure is to provide a safe driving information providing street lamp which is capable of accurately confirming an accident occurrence spot so that the accident may be readily handled and traffic congestion, which may be caused by the delayed handing of the accident, may be more rapidly solved and a safe driving information providing system using the street lamp.

Still another object of the present disclosure is to provide a safe driving providing information street lamp which is capable of providing safe driving information of a vehicle using street lamps installed at a side of a road without intervention of a traffic regulating center or a traffic operation center and a safe driving information providing system using the street lamp.

Nowadays, when maintenance and repair work is performed on a freeway or a common state road, a construction vehicle performs the work while moving slowly. In addition, a guide vehicle informs subsequent vehicles of a change of lanes while following the route of the working vehicle. However, vehicles bringing up the rear in the distance may attempt to change the lanes in a state where they approach close to the guide vehicle without recognizing the information. As a result, traffic congestion tends to be further increased.

If it is possible to inform of the performed road maintenance and repair work from a distance, the traffic congestion may be eased. However, only a notification that work is being performed in a vicinity of a specific junction or interchange is displayed on a sign board. Thus, when the work is performed while moving the work position, it is impossible to inform of the correct position.

Further, many roads were recently flooded by heavy rain and thus, damaged at many places. However, since no means for informing vehicles driven on the roads of the positions of the damaged roads exist, tires may be damaged while the vehicles are being driven to cause an accident or a driver may suddenly notice a damaged road surface and rapidly change lanes, which may cause an accident.

In order to achieve the objects as described above, the present disclosure provides a safe driving information providing street lamp. The street lamp includes: a main illumination unit that illuminates a road; a vehicle reception unit that receives an accident occurrence signal or a malfunction occurrence signal of a disabled vehicle; a control unit that generates an accident recognition signal or a malfunction recognition signal depending on whether the accident occurrence signal is received or the malfunction occurrence signal is received, the accident recognition signal and the malfunction recognition signal being generated to be distinguishable from each other; and a vehicle transmission unit that selectively transmits the accident recognition signal or the malfunction recognition signal to vehicles positioned ahead of or behind an accident spot or a malfunction spot.

Further, the present disclosure provides a system that provides safe driving information using a street lamp. The system includes: the street lamp that provides safe driving information (hereinafter, also referred to as "safe driving information providing street lamp") as described above; and a vehicle equipment part. The vehicle equipment part includes: an accident sensing unit provided in a vehicle to sense accident occurrence; an wireless transmission unit that, when the accident occurrence is sensed by the accident sensing unit, transmits the accident occurrence signal to the vehicle reception unit of the street lamp; an wireless reception unit that receives the accident recognition signal transmitted through the vehicle transmission unit of the street lamp; and an alarm unit that, when the wireless reception unit receives the accident recognition signal, notifies a driver of accident occurrence.

According to the present disclosure, when a street lamp of a corresponding road receives an wireless signal generated from an accident sensing means such as a black box or an airbag sensor installed in a vehicle when the accident sensing means senses an accident, the street lamp recognizes accident occurrence and transmits an accident occurrence signal and a signal that causes a neighboring street lamp around the street lamp that has recognized the accident to blink on and off. Thus, when an accident has occurred, a driver of a subsequent vehicle may be notified of the accident occurrence ahead of the subsequent vehicle even if there is no report or a traffic regulating center does not intervene. Consequently, a secondary rear-end collision can be prevented.

Further, according to the present disclosure, a position where a planned work is performed or an abnormality such as an abnormal road surface occurs can be correctly recognized and vehicles approaching the position can be notified of the situation from a location spaced away from the position by a predetermined distance or more. Therefore, it is possible to prevent the traffic congestion from being intensified and to prevent occurrence of a secondary accident.

DETAILED DESCRIPTION

Hereinbelow, a safe driving information providing street lamp according to an exemplary embodiment of the present disclosure and a system for providing safe driving information (hereinafter, referred to as a "safe driving information providing system") using the street lamp will be described in detail with reference to the accompanying drawings.

Figure 1:
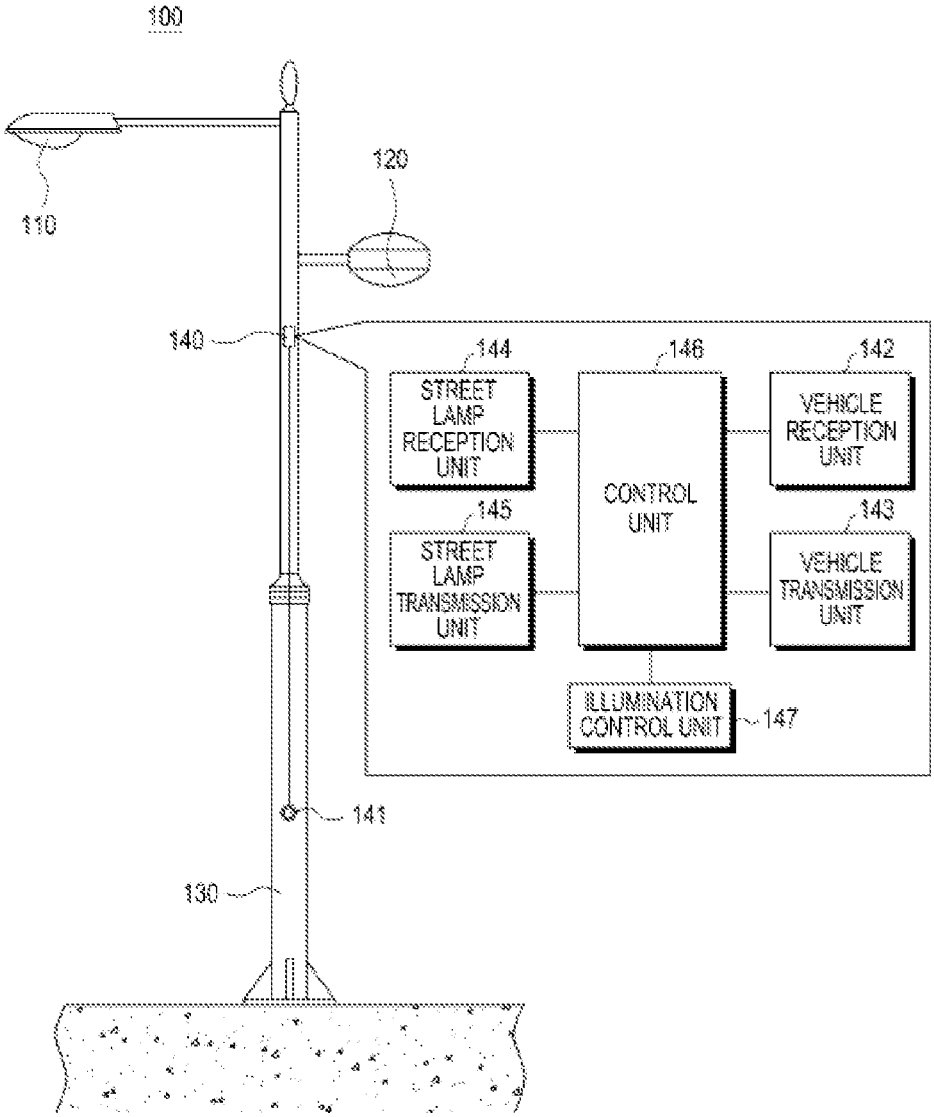
FIG. 1 is a view illustrating an embodied configuration of a safe driving information providing street lamp according to an exemplary embodiment of the present disclosure.

FIG. 1 is a view illustrating a configuration of a safe driving information providing street lamp according to an exemplary embodiment of the present disclosure.

Referring to FIG. 1, the safe driving information providing street lamp according to the exemplary embodiment of the present disclosure employs a containment building pressure control device using a liquid-driven valve.

Referring to FIG. 1, the safe driving information providing street lamp 100 according to the exemplary embodiment of the present enclosure includes: a warning lamp 120 which is capable of variably indicating colors separately from a main illumination portion 110 and of which a blinking state is controlled; and a controller 140 that receives an accident occurrence signal transmitted when an emergency bell 141 provided at a lower end of a post 130 is pushed or an accident occurrence signal transmitted from an accident vehicle and transmits an accident recognition signal to subsequent vehicles and a neighboring street lamp.

The controller 140 includes: a vehicle reception unit 142 that receives the accident occurrence signal transmitted from the accident vehicle; a street lamp reception unit 144 that receives a signal transmitted from another neighboring street lamp; and a control unit 146 that, when the accident occurrence signal is received to the vehicle reception unit 142 or when the emergency bell 141 is pushed, recognizes this to output an accident recognition signal to the subsequent vehicles through the vehicle transmission unit 143 and to make the neighboring street lamps recognize occurrence of the accident through the street lamp transmission unit 145.

Hereinafter, the configuration and acting effects of the safe driving information providing street lamp according to the exemplary embodiment of the present disclosure will be described in more detail. A configuration and acting effects of a safe driving information providing system using the safe driving information providing street lamp of the present disclosure will also be described.

Figure 2:
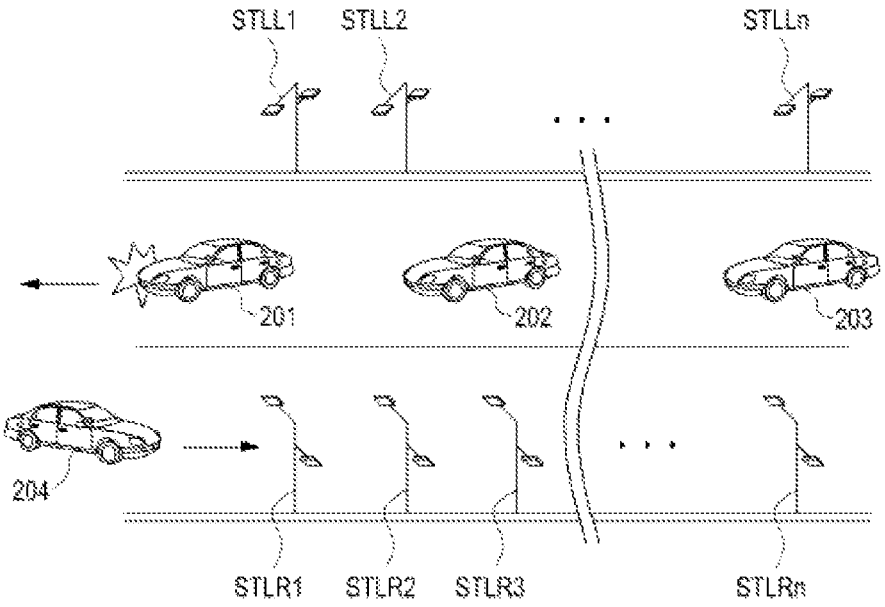
FIG. 2 is a view for describing configuration of the safe driving information providing street lamps according to the exemplary embodiment of the present disclosure and a safe driving information providing system using the safe driving information street lamp.
Figure 3:
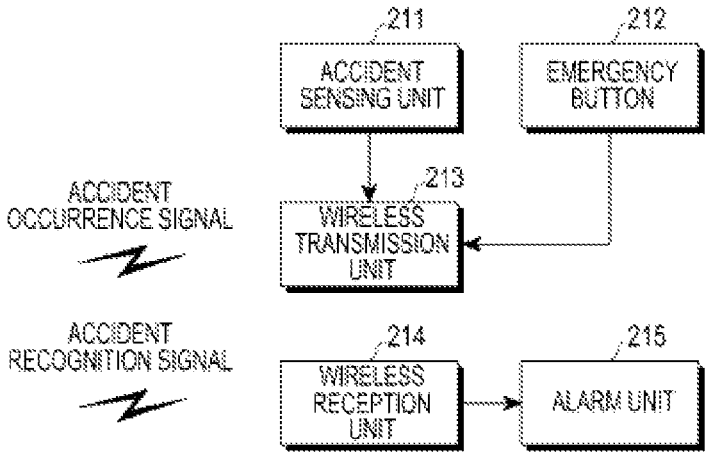
FIG. 3 is a diagram illustrating an embodied configuration of a vehicle equipment part provided in a vehicle running on a road.

FIG. 2 is a view for describing configurations of the safe driving information providing street lamps according to the exemplary embodiment of the present disclosure and a safe driving information providing system using the safe driving information street lamp, and FIG. 3 is a diagram illustrating an embodied configuration of a vehicle equipment part provided in a vehicle running on a road.

Referring to FIG. 2, vehicles 202 and 203 subsequent to an accident vehicle 201 and a vehicle 204 driven in the direction opposite to the accident vehicle 201 are being driven on a road 400, and a plurality of street lamps STLL1 to STLLn and STLR1 to STLRn are disposed adjacent to the road 400.

In addition, referring to FIG. 3, each of the subsequent vehicles 202 and 203 including the accident vehicle 201 and the vehicle 204 is provided with a vehicle equipment part 210, and the vehicle equipment part 210 includes an accident sensing unit 211 that senses a vehicle collision, an emergency button 212 that may be selected by a driver when an emergency situation occurs, a radio frequency (wireless) transmission unit 213 that transmits wireless signals which are different from each other when the accident sensing unit 211 senses an accident or the emergency button 212 is pushed; an wireless reception unit 214 that receives an accident recognition signal from the street lamps 100 or STLL1 to STLLn and STLR1 to STLRn; and an alarm unit 215 indicates that an accident has occurred ahead when the accident recognition signal received from the wireless reception unit 214.

In the configuration as described above, when the vehicle 201 has an accident while being driven on the road 400, the accident sensing unit 211 of the vehicle equipment part 210 senses the impact applied to the vehicle 201.

The accident sensing unit 211 may be a black box or an airbag sensor, for example. In particular, the black box is preferably applied to the present disclosure since it may sense the occurrence of the accident and separately store an accident image and a voice.

When the accident sensing unit 211 senses the accident, the wireless transmission unit 213 transmits an accident occurrence signal.

The accident occurrence signal of the wireless transmission unit 213 is received by the vehicle reception unit 142 of the neighboring street lamp STLL1. At this time, the control unit 146 outputs an accident recognition signal which is an wireless signal notifying that there has been an accident at the corresponding position through the vehicle transmission unit 143.

At the same time, the accident recognition signal is output to the neighboring street lamp STLL2 and the warning lamp 120 is made to blink on and off by a red color through the illumination control unit 147.

As described above, the accident recognition signal transmitted from the street lamp STLL1 is received by the wireless reception unit 214 of vehicle equipment part 210 provided in each of the subsequent vehicles 202 and 203 and the street lamp reception unit 144 of the street lamp STLL2.

Upon receiving the accident recognition signal, the subsequent vehicles 202 and 203 of the accident vehicle 201 notify the drivers thereof of accident occurrence ahead of them through an alarm unit 215.

Although the foregoing process has been described step by step according to a time flow for a detailed description, the process is handled immediately after the accident occurrence. Accordingly, the process may be executed more quickly compared to the conventional process which is handled by a traffic regulating center after receiving a report of accident occurrence or recognizing the accident occurrence. Consequently, the drivers of the subsequent vehicles 202 and 203 are capable of recognizing that the accident has occurred ahead immediately after the accident occurrence.

In addition, the accident recognition signal transmitted from the street lamp transmission unit 145 of the street lamp STLL1 has a value of m. Upon receiving the accident recognition signal with the value of m, the neighboring street lamp STLL1 controls the illumination control unit 147 to blink on and off with the red color through the control unit 146 and transmits again an accident recognition signal having a value remaining by subtracting 1 from the value, m, through the street lamp transmission unit 145.

In this manner, the street lamps up to the $m_{th}$, street lamp STTLm backward from the street lamp STLL1 where the accident was sensed with respect to the vehicle advancing direction will cause the warning lamp 120, which is provided in each of the street lamps, to blink on and off with the red color.

For this purpose, the warning lamp 120 is preferably a warning lamp using LEDs capable of displaying variable colors and a more environment-friendly LED light is preferably used in the main illumination lamp 110.

As described above, according to the present disclosure, it is possible to prevent a secondary collision by notifying subsequent vehicles of accident occurrence immediately after the accident occurrence.

The accident handling process as described above may be equally applied to the vehicles the vehicles 204 running in the opposite direction to the accident vehicles 201. This is because the accident vehicle 201 may have crossed a center divider of the road or driven over the center line of the road when no center divider exists in the road.

In the foregoing, descriptions have been made with reference to an example in which accident occurrence is notified the subsequent vehicles immediately after a vehicle rear-end collision has occurred. When a vehicle 201 is stopped by overheating, for example, in summer, or malfunction, the driver may push the emergency button 212 of the vehicle equipment part 210 of the vehicle 201. Then, the wireless transmission unit 213 transmits a malfunction occurrence signal.

In such a case, the accident occurrence signal and the malfunction occurrence signal are provided to be distinguishable from each other such that the subsequent vehicles may determine there is an accident or a malfunction. This is to allow the drivers of the subsequent vehicles to correctly recognize and properly cope with the situation on the road such as work on the road or an attention-needed condition of the road surface to be described later.

The malfunction occurrence signal is also received by the neighboring street lamp STLL1 and the illumination control unit 147 may cause the warning lamp to blink on and off with a yellow color. The color at this time is optional and does not limit the scope of the present disclosure.

In addition, the control unit 146 transmits a malfunction occurrence signal to the subsequent vehicles 202 and 203 through the vehicle transmission unit 143 and also transmits the malfunction occurrence signal to the neighboring street lamp STLL2. Then, the alarm units 215 of the vehicles 202 and 203 make an indication to be different from the indication when the accident recognition signal is received such that the drivers can recognize that a disabled vehicle exists ahead.

Then, in the same manner as that in the accident occurrence as described above, the street lamps up to the $m_{th}$, street lamp cause the warning lamps 120 to blink on and off with the yellow color such that the drivers can recognize that a disabled vehicle is stopped within a predetermined distance ahead and drive the vehicles slowly using caution.

In such a case, it is less likely that the disabled vehicle 201 crosses the center line of the road. Therefore, the vehicle equipment part 210 of the vehicle 204 in a lane opposite to that of the disabled vehicle 201 may nullify a malfunction recognition signal transmitted from the street lamp STLL1 at the opposite direction to the accident vehicles 201.

As described above, according to the present disclosure, since vehicles which may face a dangerous situation, including the vehicles subsequent to an accident vehicle or a disabled vehicle, are immediately notified of accident occurrence or malfunction occurrence, occurrence of a secondary accident may be prevented.

In addition, when a vehicle is stopped on the shoulder due to a malfunction or the like, the driver of the vehicle may push the emergency bell 141 provided in a street lamp 100 so as to notify the subsequent vehicles 202 and 203 of the accident occurrence situation at the corresponding position according to the sequence described in detail above so as to cause the warning lamp 120 of each of the street lamps within a predetermined distance backward from the position of the accident to blink on and off by a specific color.

Descriptions have been made with reference to examples which may be immediately handled without intervention of a traffic regulating center or a traffic operation center, and indication of planned work or a damaged road surface may be performed according to a control of the traffic regulating center or the traffic operation center.

Figure 4:
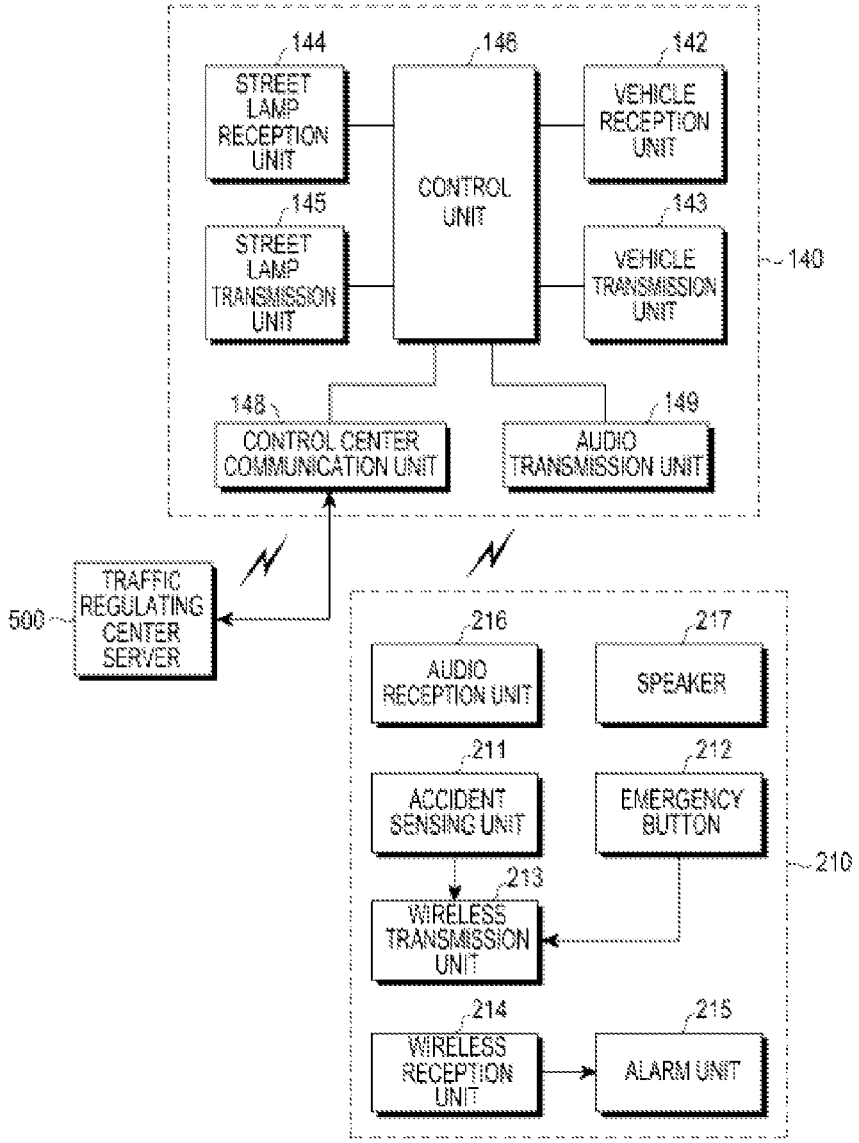
FIG. 4 is a diagram illustrating a configuration of a safe driving information providing system using a street lamp, according to another exemplary embodiment of the present disclosure.

FIG. 4 is a diagram illustrating a configuration of a safe driving information providing system using a street lamp, according to another exemplary embodiment of the present disclosure.

Referring to FIG. 4, the safe driving information providing system using a street lamp, according to another exemplary embodiment of the present disclosure further includes a control center communication unit 148 that communicates with a traffic regulating center server 500 and an audio transmission unit 149 that transmits an audio signal received from the traffic regulating center server 500 to a vehicle equipment part 210 in addition to a configuration which is the same as the controller 140 of the street lamp 100 of FIG. 1. The vehicle equipment part 210 includes an audio reception unit 216 that receives the audio signal and a speaker 217 that outputs the audio signal received by the audio reception unit 216.

The control center communication unit 148 and the traffic regulating center server 500 may communicate with each other wiredly or wirelessly, and the traffic regulating center server 500 sends an emergency signal to the controller 140 of a street lamp at a position where work is currently performed, goods are dropped on a road, or a road surface is damaged.

Upon receiving the emergency signal, the controller 140 performs the operation of notifying the subsequent vehicles of the work, the dropped goods or the damage of the road, using the street lamps within a predetermined distance from the corresponding position.

Figure 5:
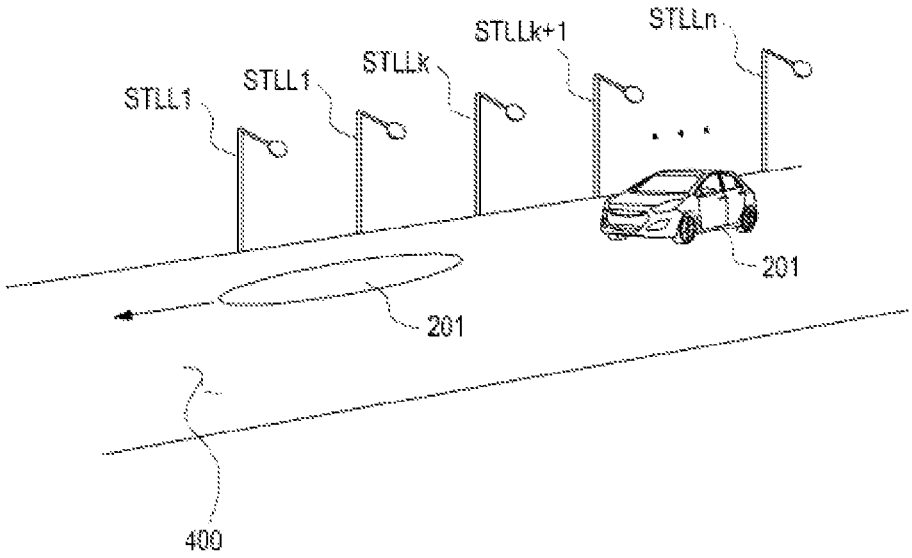
FIG. 5 is a configurational view for describing an operation of the present disclosure according to an emergency signal of a traffic regulating center server.

FIG. 5 is a configurational view for describing an operation of the present disclosure according to an emergency signal of the traffic regulating center server 500 as described above.

Referring to FIG. 5, the traffic regulating center server 500 stores data for a starting location and a progressing degree of predetermined work, and information for the damaged section of the road 400 and information for a section 410 where goods have been dropped from a freight vehicle are also stored in the traffic regulating center server 500.

At this time, according to the present disclosure, the work section, the damaged section and the dropped goods existence section 410 may be checked for each interval of the street lamps STLL1 to STLLn, which are typically installed at a 50 m interval, and notified of to the drivers.

The traffic regulating center server 50 transmits an emergency signal notifying that there is work, a damaged road or dropped goods to the control center communication unit 148 of the street lamp STLL2 corresponding to the stored section where the work is performed or the damaged road or the dropped goods exist.

Upon receiving the emergency signal, the control unit 146 of the controller 140 of the street lamp STLL2 transmits a lane change signal having a value of k through the street lamp transmission unit 145 such that it can be distinguished from the above-described cases where the vehicle accident or malfunction occurrence signal is received, and controls the illumination control unit 147.

The illumination control unit 147 causes the warning lamp 120 of FIG. 1 to blink on and off with a color which is different from the color such as yellow that is used when an accident or malfunction occurs as described above.

In addition, the lane change signal is received by a street lamp reception unit 144 of a neighboring street lamp STLL3, and, in response to the reception of the lane change signal, the street lamp STLL3 also causes the warning lamp 120 to blink on and off with the yellow color and then transmits the lane change signal to the next street lamp after subtracting 1 from the value of k. In this manner, each of the street lamps from the first street lamp STLL2 to the $k_{th}$ street lamp may activate the warning lamp 120 with the yellow color. Upon recognizing the yellow blinking state, the driver of the vehicle 201 may prepare for the lane change and drive the vehicle 201 using caution ahead of the vehicle 201. As a result, the driver may not abruptly operate the steering wheel so as to avoid a construction vehicle, a damaged road portion or dropped goods and thus, may receive help in preventing an accident.

In addition, when the construction vehicle performs work while moving, the section 410 will move from the first street lamp STLL2 to the street lamp STLL1 ahead of the street lamp STLL2. At this time, the traffic regulating center server 500 transmits an emergency signal to the street lamp STLL1 so that safe driving information corresponding with the moved section 410 can be provided.

In addition, the traffic regulating center server 500 may guide the vehicle 201 running on the corresponding road 400 of traffic information corresponding with the road 400 using voice.

Typically, traffic information of a traffic broadcast or the like is limited to major roads and freeways of a corresponding town rather than corresponding with the road 400 of which the information is required by the driver. Therefore, the information required by the driver may be omitted from the traffic information, and when the driver listens to a lot of traffic information, it is difficult for the driver to select and listen to only the information for the road 400.

The traffic information for the road 400 where the vehicle 201 currently runs may be recognized by the driver when an audio signal is transmitted to the control center communication unit 148 by each of the street lamps STLL1 to STLLn, then transmitted to the vehicle 201 through the audio signal transmission unit 149 of each of the street lamps STLL1 to STLLn, then received by the audio reception unit 216 of the vehicle equipment part 210, and then reproduced through a speaker 217.

At this time, correct information as to, for example, the number of lanes where work is being performed, or a damaged road portion or dropped goods exist may be obtained based on the audio information and the blinking of yellow-colored light from the warning lamps 120. In addition, since the driver may have enough time to change lanes before the corresponding position, it is possible to prevent accident occurrence and creation of traffic congestion may be minimized.

In the foregoing, it has been described that audio guidance is provided by transmitting an audio signal from the traffic regulating center server 500, receiving the audio signal by the control center communication unit 148, and then transmitting the audio signal to a vehicle 201. However, traffic information may be received by the controller 110 through an Internet broadcast of the corresponding territory or a radio frequency and then provided to a vehicle 201 running on the corresponding road 400 using a voice.

Figure 6:
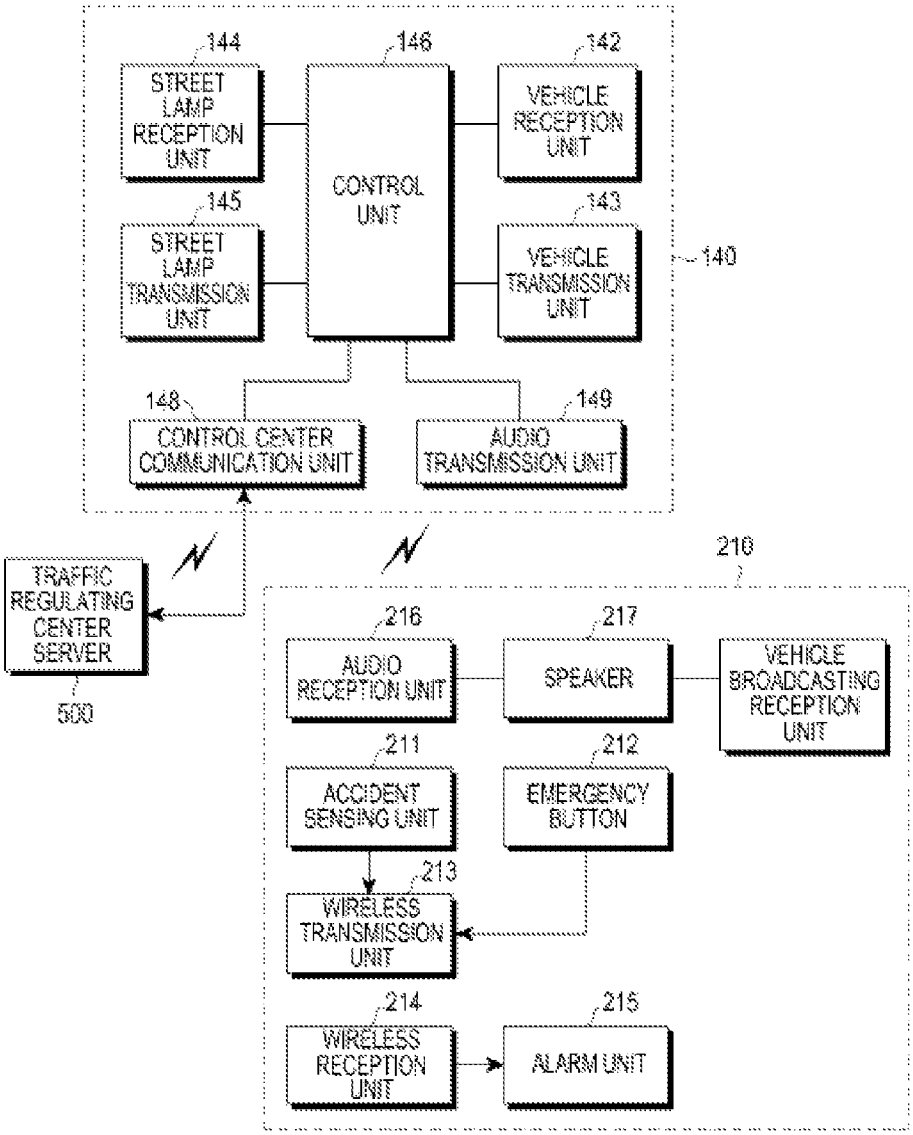
FIG. 6 is a diagram illustrating a configuration of a part of the present disclosure.

FIG. 6 is a diagram illustrating a configuration of a part of the present disclosure.

Referring to FIG. 6, a broadcast reception unit 151 that receives an Internet broadcast or a radio frequency is included in the controller 110 of the street lamp 100, and the controller 110 further includes a broadcast transmission unit 152 that transmits a broadcast signal received through the broadcast reception unit 151 to a vehicle 201 running on a road 400.

In addition, the vehicle equipment part 210 of the vehicle 201 is provided with a vehicle broadcast reception unit 153 that receives the broadcast signal of the broadcast transmission unit 152 and reproduces the broadcast signal through the above-mentioned speaker 217 so that the traffic information of the corresponding road 400 can be confirmed irrespective of the traffic regulating center server 500.

Figure 7:
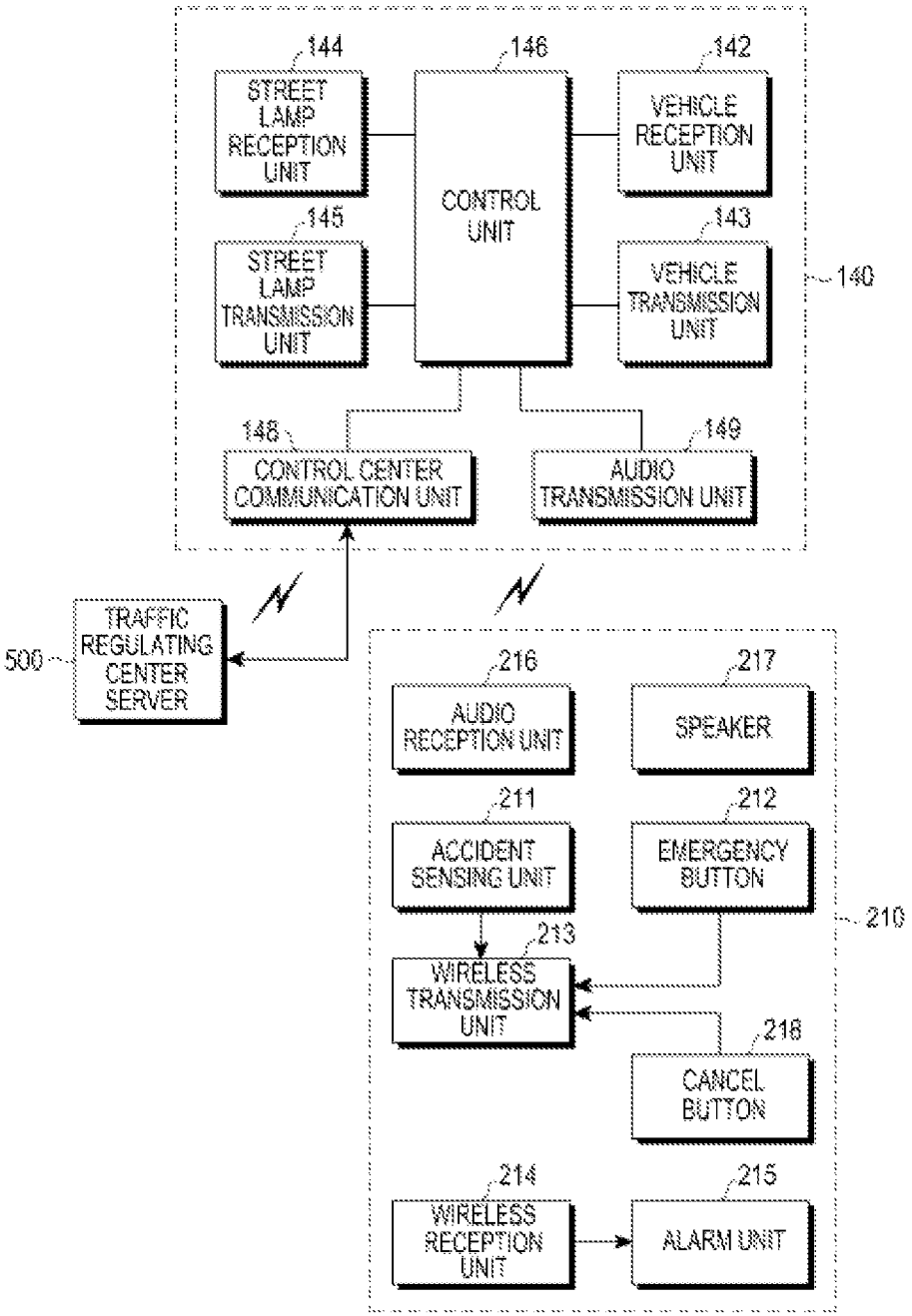
FIG. 7 is a diagram illustrating a configuration of a safe driving information providing system using a street lamp, according to still another exemplary embodiment of the present disclosure.

FIG. 7 is a diagram illustrating a configuration of a safe driving information providing system using a street lamp, according to still another exemplary embodiment.

Referring to FIG. 7, the safe driving information providing system using a street lamp according to still another exemplary embodiment may further include, in the vehicle equipment part 210 in the configuration of FIG. 4*a*, a cancel button 218 to be used by a driver or a passenger so as to cancel accident notification when there is no accident.

In the prior exemplary embodiments, it has been described that, when the accident sensing unit 211 senses an accident, the wireless transmission unit 213 transmits an accident occurrence signal, the vehicle reception unit 142 of a street lamp receives the accident occurrence signal, and then an operation according to the accident occurrence is immediately performed.

In the still another exemplary embodiment, when no accident occurs despite the fact that the accident signal was detected by the accident sensing unit 211 of the vehicle equipment part 210 or when a very minor accident has occurred and thus, the disabled vehicle can be immediately operated, the accident signal may be cancelled using the cancel button 218.

The cancel button 218 may be used in various cases and a use example of the cancel button 218 will be described in detail.

Figure 8:
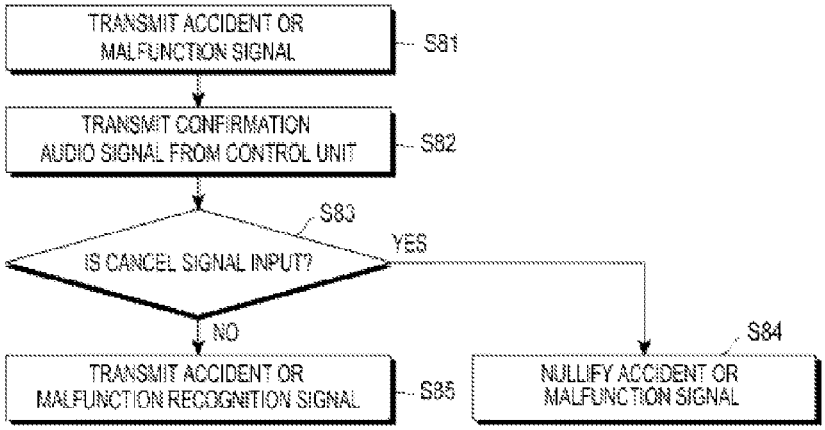
FIG. 8 is a flowchart of an operation performed by a safe driving information providing system using a street lamp of the present disclosure.

FIG. 8 is a flowchart of an operation performed by a safe driving information providing system using a street lamp of the present disclosure.

Referring to FIG. 8, the operation may include: when an accident is sensed by the accident sensing unit 211 or the emergency button 212 is pushed, transmitting an accident signal or a malfunction signal through the wireless transmission unit 213 (S81); transmitting a confirmation audio signal that confirms to a driver of a corresponding vehicle whether the accident or the malfunction has actually occurred by the control unit 146 of the controller 140 that received the accident signal or the malfunction signal (S82); confirming whether the driver who listened to the confirmation audio signal through the 217 pushes the cancel button 218 within a set length of time S83; when the cancel button 218 is pushed and the cancel signal is transmitted through the wireless transmission unit 213, nullifying the previously received accident signal or the malfunction signal by the control unit 146 of the controller 140 (S84); and when the cancel signal is not received until a predetermined length of time has elapsed after the confirmation audio signal was received by the control unit 146, determining the received accident signal or malfunction signal as effective and controlling the street lamp (S85).

Such a configuration makes it possible to cancel an accident signal or a malfunction signal provided when the accident sensing unit 211 was sensibly reacted or the emergency button 212 was pushed due to an operating error. In the configuration, the control unit 146 of the controller 140 is configured to confirm whether the accident signal or the malfunction signal is true or false.

The confirmation audio signal may be a confirming voice such as "Is it an accident?" or "Is it malfunction?" and may use other alarm sounds.

At this time, when it is not an accident or malfunction, a driver or a passenger may push the cancel button 218 to transmit a cancel signal and then, the control unit 146 of the controller 140 nullifies the received accident signal or malfunction signal. In this manner, when it is reconfirmed whether it is an accident or malfunction in order to prevent a malfunction, the reliability of the system may be enhanced and slowing of neighboring vehicles or traffic congestion which may be caused due to the occurrence of the malfunction can be prevented.

When an actual accident has occurred, a driver or a passenger may be in a state where the driver or the passenger cannot perform a special operation. Thus, when a predetermined length of time has elapsed after transmitting a confirmation audio signal, the control unit 146 of the controller 140 determines that an accident or malfunction has occurred and performs various processes of handling the accident as described in detail above.

Figure 9:
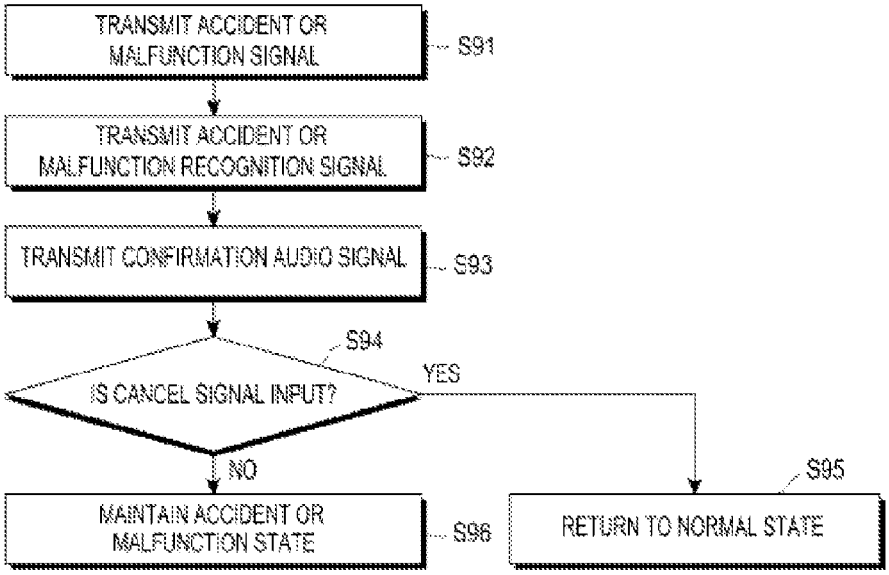
FIG. 9 is a flowchart of another operation performed by the safe driving information providing system using the street lamp of the present disclosure.

FIG. 9 is a flowchart of another operation performed by the safe driving information providing system using the street lamp of the present disclosure.

Referring to FIG. 9, the operation may include: when an accident is sensed by the accident sensing unit 211 or the emergency button 212 is pushed, transmitting an accident signal or a malfunction signal through the wireless transmission unit 213 (S91); controlling a street lamp by the control unit 146 of the controller 140 that received the accident signal or the malfunction signal according to the malfunction signal or the accident signal (S92); transmitting a confirmation audio signal that confirms to a driver of a corresponding vehicle whether the accident or the malfunction actually occurred from the control unit 146 of the controller 140 that has received the accident signal or the malfunction signal (S93); confirming whether a cancel signal is received by the controller 140 within a predetermined length of time after the confirmation audio signal was transmitted (S94); when the driver who listened to the confirmation voice signal through the speaker 217 pushes the cancel button 218 to transmit the cancel signal through the wireless transmission unit 213, nullifying the previously received accident signal or malfunction signal and stopping the control of the street lamp by the control unit 146 (S95); and when the cancel signal is not received until a predetermined length of time has elapsed after the confirmation audio signal was received by the control unit 146, determining the received accident signal or malfunction signal as effective and maintaining the street lamp under a controlled state (S96).

In the exemplary embodiment described above with reference to FIG. 8, when the street lamp is controlled only when the control unit 146 of the controller 140 that has received the accident signal confirms whether the accident or malfunction has actually occurred and then determines that the accident or malfunction has actually occurred, the handling of the accident or malfunction may be delayed during the period of time for confirming and determining whether the accident or malfunction has occurred.

In order to prevent this, in step S92, the control unit 146 of the controller 140 performs a process of handling the accident or malfunction immediately after the accident signal or the malfunction signal is received, and transmits a confirmation audio signal to the corresponding vehicle while performing the process of handling the accident or malfunction. When the cancel button 218 is pushed and a cancel signal is input in response to the confirmation audio signal, the control unit 146 performs a control to interrupt the process of handling the accident or malfunction.

When the cancel signal is not received within a predetermined length of time, the control unit 146 of the controller 140 determines that the accident or malfunction has actually occurred and continuously maintains the process of handling the accident or malfunction.

In connection with the application of the cancel button 218, although it has been described that it is applied to the exemplary embodiment described with reference to FIG. 4, it is natural that the cancel button 218 may also be applied to the exemplary embodiment described with reference FIG. 6 in the same manner.

The exemplary embodiments described with reference to FIGS. 7 to 9 are configured to confirm whether an accident or malfunction has actually occurred from an object other than the vehicle equipment part 210 in the state where the accident or malfunction has actually occurred. Unlike this, it is also possible to confirm directly from the vehicle equipment part 210 whether the accident or malfunction has actually occurred.

Figure 10:
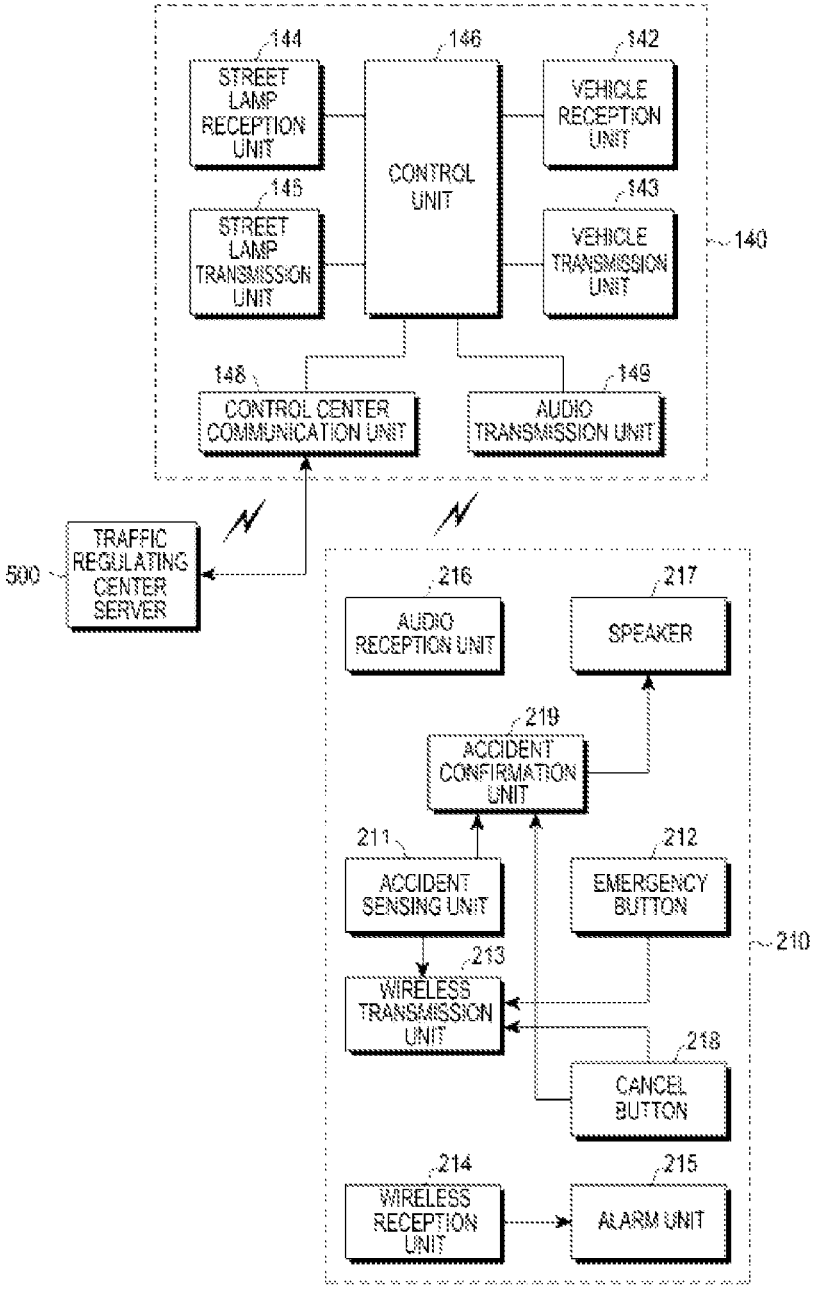
FIG. 10 is a diagram illustrating a configuration of a safe driving information providing system using a street lamp, according to yet another exemplary embodiment.

FIG. 10 is a diagram illustrating a configuration of a safe driving information providing system using a street lamp, according to yet another exemplary embodiment.

Referring to FIG. 10, the vehicle equipment part 210 further includes an accident confirmation unit 219.

When an accident is sensed by the accident sensing unit 211 of the vehicle equipment part 210, an accident occurrence signal is transmitted directly through the wireless transmission unit 213 or it is confirmed through the accident confirmation unit 219 whether the accident has actually occurred depending on the intensity of the accident signal detected by the accident sensing unit 211.

That is, when the intensity of the accident signal detected by the accident sensing unit 211 is higher than a set value, it is determined that an accident has occurred and an accident occurrence signal is transmitted to the outside through the wireless transmission unit 213. However, when the intensity of the accident signal is lower than the set value, it is confirmed from the driver through the speaker whether the accident has occurred.

At this time, when there is not an input of the cancel button 218 within a predetermined length of time as in the above-described, it is determined that the accident has actually occurred and when there is an input of the cancel button 218, it is determined that it is not an accident and a corresponding process is performed.

Since the handling processes depending on whether an accident has occurred have been fully described in the above-described exemplary embodiments, further descriptions will be omitted.

It is obvious to a person ordinarily skilled in the art that the present disclosure is not limited to the above-described exemplary embodiments and may be variously modified or changed without departing from the technical idea and scope of the present disclosure.

For example, in the above-described exemplary embodiments, examples in which signal flows are transferred to the street lamps positioned behind an accident spot have been described. However, it may be considered that the signal flows are transferred to the street lamps positioned ahead of the accident spot.

The present disclosure notifies a driver of a vehicle running in the vicinity of a street lamp installed at a side of a road of occurrence of a vehicle accident or malfunction using the street lamp. As a result, the present invention is capable of preventing a secondary accident and thus has industrial applicability.

The invention claimed is:

1. A street lamp for providing safe driving information, the street lamp comprising:

a main illumination unit that illuminates a road;

a vehicle reception unit that receives an accident occurrence signal or a malfunction occurrence signal of a disabled vehicle;

a control unit that generates an accident recognition signal or a malfunction recognition signal depending on whether the accident occurrence signal is received or the malfunction occurrence signal is received, the accident recognition signal and the malfunction recognition signal being generated to be distinguishable from each other;

a vehicle transmission unit that selectively transmits the accident recognition signal or the malfunction recognition signal to vehicles positioned ahead of or behind an accident spot or a malfunction spot;

a street lamp transmission that selectively transmits the accident recognition signal or the malfunction recognition signal to neighboring street lamps ahead and behind with respect a vehicle running direction; and a street lamp reception unit that receives the accident recognition signal or the malfunction recognition signal from the neighboring street lamps ahead and behind with respect a vehicle running direction, wherein the accident recognition signal or the malfunction recognition signal received through the street lamp reception unit is selectively transmitted to the neighboring street lamps ahead and behind with respect to the running direction of the vehicle through the street lamp transmission unit after subtracting 1 from a value of the accident recognition signal or the malfunction recognition signal.

2. The street lamp of claim 1, further comprising:

an illumination control unit that outputs different driving signals depending on whether the accident occurrence signal is received or the malfunction occurrence signal is received; and a warning lamp that emits light of a color corresponding with a driving signal output from the illumination control unit.

3. The street lamp of claim 1, wherein, when an emergency bell provided at a lower side of a street lamp post is pushed, the control unit transmits the accident recognition signal or the malfunction recognition signal through the vehicle transmission unit and the street lamp transmission unit.

4. The street lamp of claim 3, further comprising:

a control center communication unit that communicates with a traffic regulating center server to receive an audio signal and an emergency signal; and an audio transmission unit that transmits the audio signal to the vehicles, wherein according to the emergency signal, the warning lamp is caused to blink on and off with a color which is different from a color at the time of receiving the accident occurrence signal or the malfunction occurrence signal.

5. The street lamp of claim 1, further comprising:

a broadcast reception unit that receives an Internet broadcast or a radio frequency; and a broadcast transmission unit that transmits the broadcast signal received through the broadcast reception unit to the vehicles to inform drivers of a traffic situation of the road where the vehicles currently run.

6. A system for providing safe driving information using a street lamp, the system comprising:

the street lamp for providing safe driving information; and a vehicle equipment part, wherein the vehicle equipment part comprises:

an accident sensing unit provided in a vehicle to sense accident occurrence;

an wireless transmission unit that, when the accident occurrence is sensed by the accident sensing unit, transmits an accident occurrence signal to the vehicle reception unit of the street lamp;

an wireless reception unit that receives an accident recognition signal transmitted through the vehicle transmission unit of the street lamp;

an alarm unit that, when the wireless reception unit receives the accident recognition signal, notifies a driver of the accident occurrence; and an emergency button to be capable of being selected by a driver when a vehicle has malfunction, and wherein, when the emergency button is pushed, a malfunction occurrence signal is transmitted to the vehicle reception unit of the street lamp for providing safe driving information through the wireless transmission unit.

7. The system of claim 6, wherein the vehicle equipment part further comprises:

an audio reception unit that notifies the traffic information of the corresponding road transmitted through the audio transmission unit of the street lamp for providing safe driving information; and a speaker that reproduces the traffic information received through the audio reception unit.

8. The system of claim 7, wherein the vehicle equipment part further comprises:

a cancel button that is capable of cancelling the accident occurrence signal or the malfunction occurrence signal after receiving, through the audio reception unit, the confirmation audio signal received by the control unit.

9. The system of claim 8, wherein the vehicle equipment part further comprises:

an accident confirmation unit that outputs an audio signal to confirm whether the accident has occurred through the speaker when the signal sensed by the accident sensing unit is lower than a reference signal, senses whether the cancel button is pushed, and cancels the accident occurrence signal when the cancel button is selected.

10. A street lamp for providing safe driving information, the street lamp comprising:

a main illumination unit that illuminates a road;

a vehicle reception unit that receives an accident occurrence signal or a malfunction occurrence signal of a disabled vehicle;

a control unit that generates an accident recognition signal or a malfunction recognition signal depending on whether the accident occurrence signal is received or the malfunction occurrence signal is received, the accident recognition signal and the malfunction recognition signal being generated to be distinguishable from each other, wherein the control unit transmits a confirmation audio signal that confirms whether the received accident signal or malfunction signal is true or false though the audio transmission unit, and when a cancel signal is received within a predetermined length of time after transmitting the confirmation audio signal, the control unit nullifies the received accident signal or malfunction signal; and a vehicle transmission unit that selectively transmits the accident recognition signal or the malfunction recognition signal to vehicles positioned ahead of or behind an accident spot or a malfunction spot.

11. The street lamp of claim 10, wherein the accident signal or the malfunction signal is nullified before or after transmitting the accident recognition signal or the malfunction recognition signal.

This change was needed for a "requirement" by the PTO that a claim cannot depend from a subsequent claim.

* * * * *